US005913462A

United States Patent [19]

Petrou

[11] Patent Number: 5,913,462

[45] Date of Patent: Jun. 22, 1999

[54] HANGER WITH IMPROVED INFORMATION TAB AND TAB RECEIVER

[76] Inventor: Nicoleon Petrou, 2498 Roll Dr., #407, San Diego, Calif. 92173

[21] Appl. No.: 08/962,070

[22] Filed: Oct. 31, 1997

[51] Int. Cl.[6] ..... A47G 25/14

[52] U.S. Cl. ..... 223/85; 40/322

[58] Field of Search ..... 223/85, 86, 92, 223/95; 40/322; D6/315

[56] References Cited

U.S. PATENT DOCUMENTS

| | | | |
|---|---|---|---|
| 4,997,114 | 3/1991 | Petrou | 223/85 |
| 5,383,583 | 1/1995 | Zuckerman | 223/85 |
| 5,407,109 | 4/1995 | Zuckerman | 223/85 |
| 5,441,182 | 8/1995 | Sullivan | 223/85 |
| 5,485,943 | 1/1996 | Zuckerman | 223/85 |
| 5,524,801 | 6/1996 | Dooley et al. | 223/85 |
| 5,590,822 | 1/1997 | Zuckerman | 223/85 |
| 5,597,100 | 1/1997 | Blitz | 223/85 |
| 5,613,629 | 3/1997 | Zuckerman | 223/85 |

*Primary Examiner*—Bibhu Mohanty
*Attorney, Agent, or Firm*—Frank G. Morkunas

[57] ABSTRACT

A garment hanger having body and a hook connected to the body and a tab receiver integrally formed with the hanger. The tab receiver has two spaced-apart flexible receiver members each having paired steps projecting in opposite directions defining an individual step width and, in combination, a combined width. A rigid tab having two paired projections and openings cooperates with the flexible receiver members and the steps to compress the combined widths as the tab projections pass over the cooperating steps of the receiver members and to release and return the compressed widths to their original combined widths which are wider that the projection openings thereby locking and securely retaining the tab onto the tab receiver. A locking member on the base of the tab inserts into the space between the two receiver members, overlaps the two receiver members, and exerts opposing pressure on the two receiver members thereby preventing their movement and removal of the tab.

12 Claims, 2 Drawing Sheets

HANGER WITH IMPROVED INFORMATION TAB AND TAB RECEIVER

CROSS REFERENCES TO RELATED APPLICATIONS

None

STATEMENT REGARDING FEDERALLY-SPONSORED RESEARCH OR DEVELOPMENT

None

BACKGROUND OF THE INVENTION

This present invention relates to an improvement in garment hangers, and more particularly to garment hangers having information tabs thereon which, after being attached thereto, are irremovable.

Information tabs on garment hangers display relevant information to a consumer as to the garment such as, but not limited to, size, manufacturer, brand, materials, and the like. A variety of means exist to convey such information. These include placing disks or rings on the garment hanger and inserting clip-like tabs on the hanger body. Though these means are suitable for the intended purpose, their ease of removal, by a customer or others, diminishes their utility. Easy removal has also proven to be a hazard for young children, particularly with small clip-like devices. With flexible tabs, no matter how well designed, children's curiosity, tenacity, and prying fingers can generally remove such tabs. Once so removed, either in the store or at home, a child of tender years may be apt to swallow the tab.

It is preferable to produce garment hangers which accommodate virtually irremovable information tabs. This has been recognized by others for which several patents have issued. These patents include U.S. Pat. No. 5,613,629 issued to Zuckerman on Mar. 25, 1997; U.S. Pat. No. 5,485,943 issued to Zuckerman on Jan. 23, 1996; U.S. Pat. No. 5,383,583 issued to Zuckerman on Jan. 24, 1995. Each of these patents basically incorporate somewhat flexible clip-type tabs locking onto rigid tab receivers. The tabs have ridges which fit over and lock under ridges on the tab holder. The prior art devices utilize a 'clipping' principle and there is no further locking mechanism to ensure against removal. Because of the rigidity of the tab holder and, though somewhat flexible, the rigidity of the tab itself, these devices are difficult to use and provide no additional fail-safe locking mechanism. A need exists to make information tabs easier to use and more secure so that children cannot remove them. Use of a rigid tab with or without a locking mechanism satisfies that need.

Accordingly, several objects and advantages of my invention are:

a. to provide a garment hanger with an irremovable tab;

b. to provide a garment hanger having a tab and tab receiver which are easy to use;

c. to provide an additional locking member on the tab to ensure against its unwanted removal; and d. to provide for a garment hanger with all the above features which is relatively inexpensive to manufacture.

The foregoing has outlined some of the more pertinent objects of the present invention. These objects should be construed to be merely illustrative of some of the more prominent features and applications of the intended invention. Many other beneficial results can be attained by applying the disclosed invention in a different manner or by modifying the invention within the scope of the disclosure. Accordingly, other objects and a fuller understanding of the invention may be had by referring to the summary of the invention and the detailed description of the preferred embodiment in addition to the scope of the invention defined by the claims taken in conjunction with the accompanying drawings.

BRIEF SUMMARY OF THE INVENTION

The above-noted problems, among others, are overcome by the present invention. Briefly stated, the present invention contemplates a garment hanger having body and a hook connected to the body and a tab receiver integrally formed with the hanger. The tab receiver has two spaced-apart flexible receiver members each having one or more paired steps projecting in opposite directions defining an individual step width and, in combination, defining a combined width. A rigid tab having two paired projections and openings cooperates with the flexible receiver members and the respective steps to compress the combined widths as the respective tab projections pass over the respective cooperating steps of the receiver members and to release and return the compressed widths to their original combined widths which are wider that the projection openings thereby locking and securely retaining the tab onto the tab receiver. A locking member on the base of the tab inserts into the space between the two receiver members, overlaps the two receiver members, and exerts opposing pressure on the two receiver members thereby preventing their movement and removal of the tab.

The foregoing has outlined the more pertinent and important features of the present invention in order that the detailed description of the invention that follows may be better understood so the present contributions to the art may be more fully appreciated. Additional features of the present invention will be described hereinafter which form the subject of the claims. It should be appreciated by those skilled in the art that the conception and the disclosed specific embodiment may be readily utilized as a basis for modifying or designing other structures and methods for carrying out the same purposes of the present invention. It also should be realized by those skilled in the art that such equivalent constructions and methods do not depart from the spirit and scope of the inventions as set forth in the appended claims.

BRIEF DESCRIPTION OF THE DRAWINGS

For a fuller understanding of the nature and objects of the invention, reference should be had to the following detailed description taken in conjunction with the accompanying drawings in which.

DETAILED DESCRIPTION OF THE INVENTION

Figure 1:
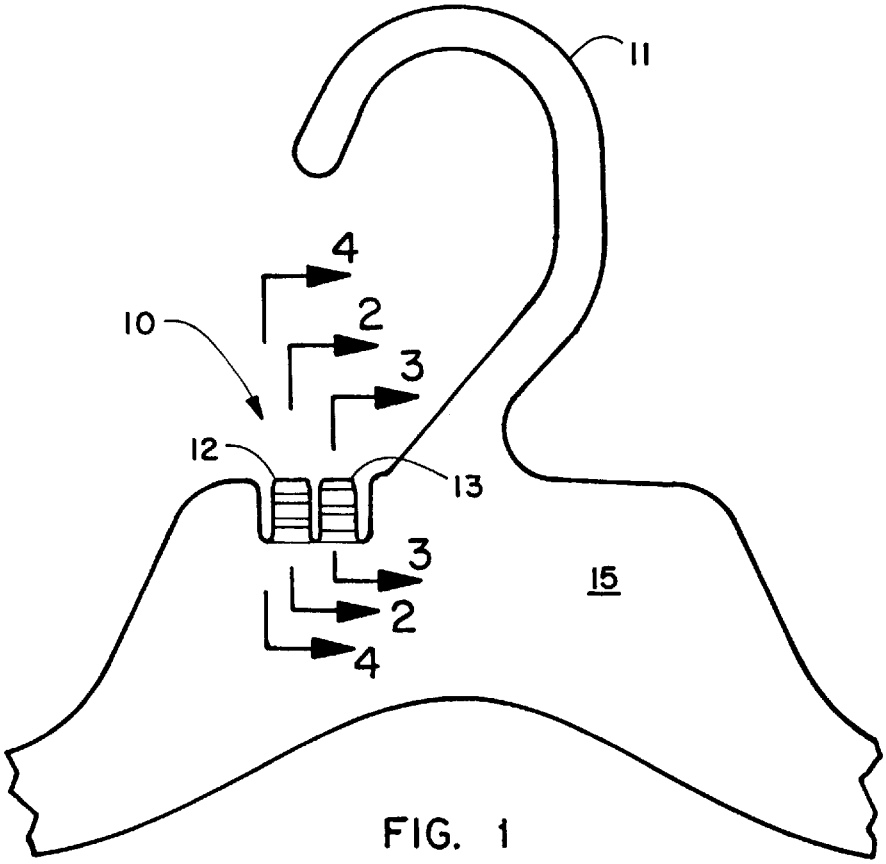
FIG. 1 is a partial view of a garment hanger showing the receiver members.

Referring now to the drawings in detail and in particular to FIG. 1, reference character 10 generally designates a garment hanger constructed in accordance with a preferred embodiment of the present invention. As is typical with garment hangers, it has a body 15 and a hook member 11. In the preferred embodiment of the present invention the tab receiver has a first receiver member 12 and a second receiver 13. Other embodiments may have more or less such receiver members. Two have been found to be economical and suited for the intended purpose.

Figure 9:
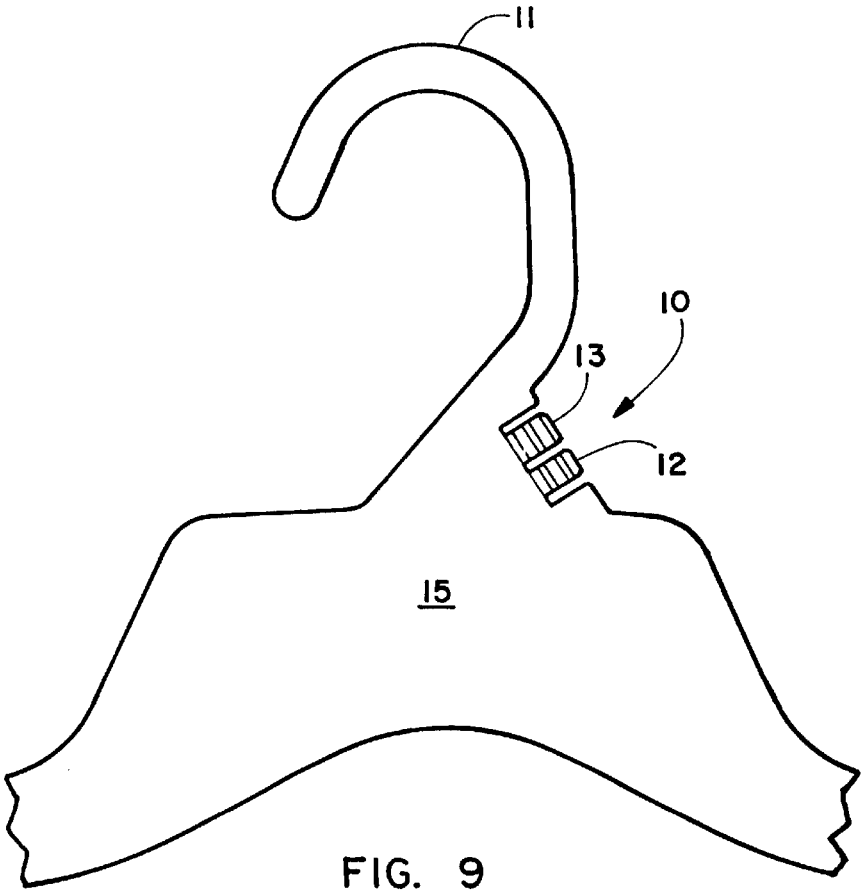
FIG. 9 is a partial view of a garment hanger illustrating alternate placement of the receiver members.

The two receiver members may be spaced apart from one another or adjacent to one another. The location of the tab receiver can be on the body 15, on the hook 11, or any combination thereof. FIG. 9 illustrates the tab receiver connected at one end to the hook 11 and at another end to the body. It must be understood that the tab receiver may be located anywhere on the garment hanger.

Figure 2:
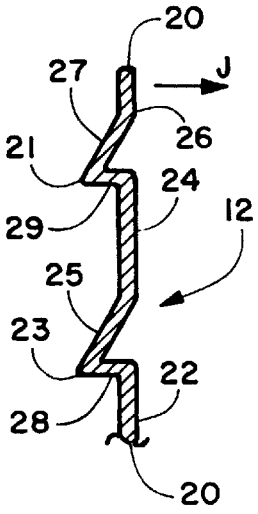
FIG. 2, taken on line 2—2 of FIG. 1, is an end view of one receiver member.
Figure 3:
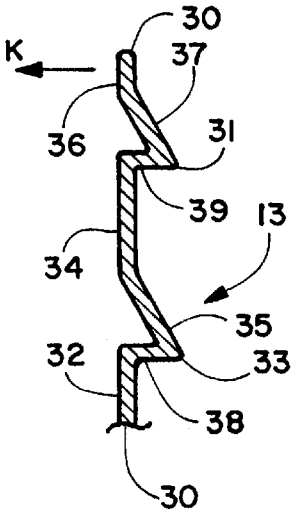
FIG. 3, taken on line 3—3 of FIG. 1, is an end view of a second receiver member.

FIGS. 2 and 3 illustrate a preferred embodiment of the individual components of the tab receiver. The first receiver member 12 has a first step 21 and a second step 23 which projects outward from its opposite side, designated by reference character 20. This opposite side to the first receiver 12, in this embodiment, forms an imaginary vertical line 20 from top to bottom. The first receiver 12 is thus formed, from top to bottom, by a first vertical member 26, followed downward and outward by a first diagonal member 27 terminating at the angled end which forms the end of the first step 21, followed inward by a first horizontal member 29 to a second vertical member 24, downward to a second diagonal member 25, downward and outward therefrom terminating at the angled end which forms the end of the second step 23, followed inward by a second horizontal member 28 to a third vertical member 22, and downward therefrom to attach to the garment hanger.

The second receiver member 13, as illustrated in FIG. 3, is the structural reverse image as that of the first receiver member 12. The second receiver member 13 has a first step 31 and a second step 33 which projects outward from its opposite side designated by reference character 30. This opposite side to the second receiver 13, in this embodiment, forms an imaginary vertical line 30 from top to bottom. The second receiver 13 is thus formed, from top to bottom, by a first vertical member 36, followed downward and outward by a first diagonal member 37 terminating at the angled end which forms the end of the first step 31, which is paired with the first step 21 of the first receiver member 12. The respective steps are on substantially the same horizontal plane. A first horizontal member 39 continues inward to a second vertical member 34, downward to a second diagonal member 35, downward and outward therefrom terminating at the angled end which forms the end of the second step 33 of the second receiver member 13. These respective second steps of the first receiver member 12 and the second receiver member 13 are on substantially the same horizontal plane. A second horizontal member 38 continues inward to a third vertical member 32, and downward therefrom to attach to the garment hanger.

Each receiver member 12 and 13 is flexible and can move in the directions depicted by arrows J and K. From the end of the first step 21 to opposite side 20 is referred to as the first step width of the first receiver member. From the end of the second step 23 to the opposite side 20 is referred to as the second step width of the first receiver member. Similarly, from the end of the first step 31 to opposite side 30 is referred to as the first step width of the second receiver member. From the end of the second step 33 to the opposite side 30 is referred to as the second step width of the second receiver member. This correlation can best be seen in FIG. 4.

Figure 4:
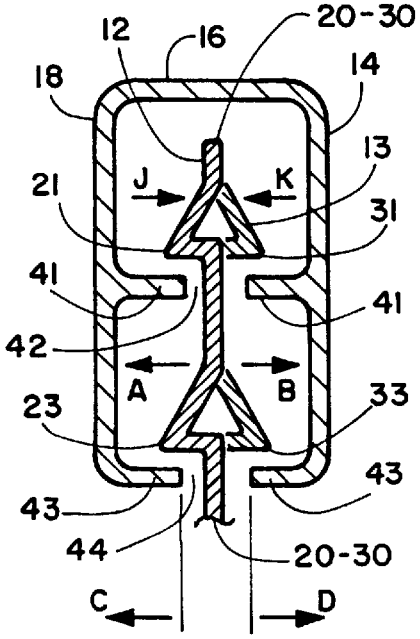
FIG. 4, taken on line 4—4 of FIG. 1, is an end view of both receiver members lined up with a tab covering the receiver members.

FIG. 4 illustrates the configuration of the first receiver member 12 in line with the second receiver member 13. This figure is not to scale and is presented as such for clarity. With the two receiver members 12 and 13 in line, a first combined width is defined from the end of the first step 21 of the first receiver member 12 to the end of the first step 31 of the second receiver member 13. Similarly, a second combined width is defined from the end of the second step 23 of the first receiver member 12 to the end of the second step 33 of the second receiver member 13.

A tab 14 has been inserted over the tab receiver. The tab 14 is a basic U-shape design having a base 16 and two side walls 18 connected thereto forming a vertex or corner. Attached to the side walls is a first paired projection 41. The tab 14, unlike other tabs, is substantially rigid and may be made from any suitably rigid material suited for the intended purpose including, but not limited to, metal, polymers, and polycarbons, and the like. It should be understood that the tab 14 may also be made of flexible material but that renders it susceptible to being pried open by fingers. The more rigid the tab, the less likely it is to be pried open.

A first opening width 42 is defined between the ends of the first paired projections 41 and is referenced as distance A-B. A second set of paired projections 43 are formed at the opposite end of the base 16. A second opening width 44 is defined between the ends of the second paired projections 43 and is referenced as distance C-D. First opening width A-B is substantially co-equal to the width of the first step width of each respective receiver member 12 and 13; that is, from reference numeral 21-20 on the first receiver member 12 and from reference numeral 31-30 on the second receiver member 13. The first opening width A-B may also be substantially larger than the first step width of each respective receiver member 12 and 13. The first combined width of the receiver members 12 and 13, however, is substantially larger than the first opening width A-B. Second opening width C-D is substantially co-equal to the width of the second step width of each respective receiver member 12 and 13. The second opening width C-D may also be substantially larger than the second step width of each respective receiver member 12 and 13. The second combined width of the receiver members 12 and 13, however, is substantially larger than the second opening width C-D. In all cases, the second width opening is sufficiently wide to permit passage of the first step width of the respective receiver members 12 and 13.

In operation, as the tab 14 is inserted onto the tab receiver and its respective receiver members 12 and 13, the second paired projections 43 contact and compress the first combined width of the first and second receivers 12 and 13, in the movement of arrows J and K respectively, to any lesser width down to substantially the first step width, to permit passage of the tab 14 thereover. When the respective first horizontal members 29 and 39 pass through, the respective receiver members return to their original combined width configuration to prevent reverse movement. In further insertion of the tab 14, the second paired projections 43 contact and compress the second combined widths of the first and second receivers 12 and 13, also in the movement of arrows J and K respectively, but to a lesser degree, to permit passage of the tab 14 thereover. The combined width is reduced to any lesser width down to substantially the width of the second step width. Nearly simultaneous therewith, the first combined width of the respective first and second receiver members 12 and 13 contact the first paired projections 41. The combined width thereby compresses, as above described, and passes therethrough.

After the passage of the first steps through the first paired projections 41 and the passage of the second steps through the second paired projections 43, each paired step returns to its original combined widths substantially overlapping their respective projections. There are snugly and securely held thereat.

Figure 5:
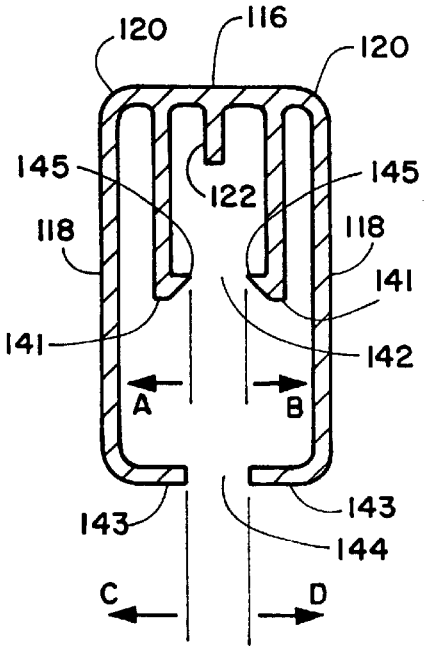
FIG. 5 is a second embodiment of a tab which also illustrates the locking member.

FIG. 5 represents another embodiment of a tab 114 which may be used on the tab receiver described above. In this embodiment, the first paired projections 141 emanate from the base 116 of the tab 114. The second paired projections 143 emanate from the side walls 118 at the opposite end from the base 116. The respective opening widths 142 and 144 are represented by reference characters A'-B' and C'-D'. Like the previous tab 14, the second paired projections 143 are the catching members of the respective second steps 23 and 33. Unlike the previous tab 14, the first paired projections 141 have inwardly protruding catching members 145 to serve the purpose of locking onto and retaining the respective first steps 21 and 31.

The operation of this tab 114 is substantially similar to the operation of the tab 14 described above. Unlike the prior tab 14 which is rigid throughout, the first paired projections 141 in this embodiment, though rigid, but because of their configuration from the base 116, they flex slightly. They may also be made of a flexible material, but rigid is best. The base for both tabs 116 and 16, particularly in the vertexes or corners 120, is substantially thicker than the side walls 118 and 18. This produces a more externally rigid tab 14 or 114.

It must be understood, however, that the tab 114 described above is suited for any type of tab receiver having one or more protrusions as its catching members such as, but not limited to, steps, stops, ridges, walls, and the like.

A locking member 120 is also shown in this embodiment but such a locking member may also be incorporated in the tab 14 described previously. The locking member 120 is a ridge-like member or wall which is configured such that, when the tab 114 is inserted over the tab receiver, the locking member 120 fits into the space separating the first receiver member 12 and the second receiver member 13 and substantially overlaps longitudinally onto each respective receiver member. Such overlapping prevents either receiver member from moving and thereby, unlocking. The locking member 120 may be parallel to each receiver member or slightly skewed to thereby facilitate the overlapping process. The locking member 120 may be substantially straight or beveled. Where beveled, the further the tab 114 inserts onto the tab receiver and into the space between the two receiver members 12 and 13, the more each receiver member is pushed away from the other receiver member in the direction of its respective step ends thereby further increasing the combined widths of the respective paired steps and more securely and irremovable locking the tab 114 into place.

Figure 6:
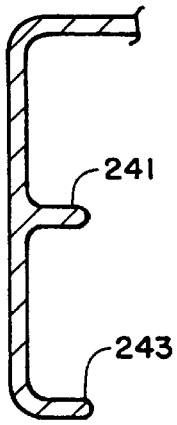
FIG. 6 is a partial view of another embodiment of the tab.
Figure 7:
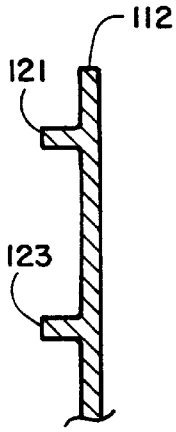
FIG. 7 is a partial view of another embodiment of one receiver member.
Figure 8:
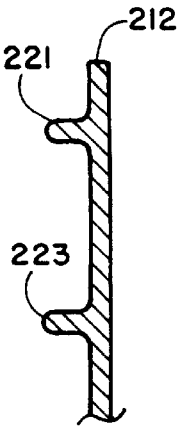
FIG. 8 is a partial view of yet another embodiment of one receiver member.

FIGS. 6 through 8 show that the projection ends 241 and 243, in addition to being angled and flat as previously shown, may also be rounded; and that the first and second steps 121 and 123 may also be flat or rounded 221 and 223. In whatever configuration, however, the respective projections and steps must cooperate with one another to compress, return, and lock the respective receiver members onto the respective projections.

FIG. 9 also illustrates that the receiver members 12 and 13 may be substantially adjacent to one another and that their respective first vertical members 26 and 36 may be eliminated if desired. The tab and tab receiver will function equally well with or without such first vertical members.

The present disclosure includes that contained in the present claims as well as that of the foregoing description. Although this invention has been described in its preferred forms with a certain degree of particularity, it is understood that the present disclosure of the preferred forms has been made only by way of example and numerous changes in the details of construction and combination and arrangement of parts may be resorted to without departing from the spirit and scope of the invention. Accordingly, the scope of the invention should be determined not by the embodiment[s] illustrated, but by the appended claims and their legal equivalents.

The invention claimed is:

1. A garment hanger having body and a hook connected to the body comprising:

a. a tab receiver integrally formed with said hanger, said tab receiver comprising at least a first receiver member and at least a second receiver member spaced apart from said first receiver member, each said receiver member being flexible on said body and each said receiver member further having one or more paired steps projecting in opposite directions with each of said one or more paired steps defining a step width for each said receiver member and further defining a combined width in relation to both of said receiver members; and b. a tab having a base, an outer surface, an inner surface with side walls thereon, and one or more paired projections on said inner surface with each of said one or more paired projections defining an opening width for compressing the combined width of said one or more paired steps on said tab receiver to substantially that of the step width of said one or more steps thereby permitting said tab to pass over said tab receiver and after such passage, for said one or more paired steps to return to their respective combined width such that said one or more paired steps lock onto said one or more paired projections and securely retain said tab on said tab receiver.

2. The hanger as defined in claim 1 wherein said one or more paired tab steps are substantially angled.

3. The hanger as defined in claim 1 wherein said one or more paired tab steps are substantially flat.

4. The hanger as defined in claim 1 wherein said one or more paired tab steps are substantially rounded.

5. The hanger as defined in claim 1 wherein said one or more paired projections have ends which are substantially angled.

6. The hanger as defined in claim 1 wherein said one or more paired projections have ends which are substantially flat.

7. The hanger as defined in claim 1 wherein said one or more paired projections have ends which are substantially rounded.

8. The hanger as defined in claim 1 wherein a first of said step widths is substantially co-equal to a first of said projection opening widths and a second of said step widths is substantially co-equal to a second of said projection opening widths.

9. The hanger as defined in claim 1 wherein a first of said step widths is substantially less in width than a first of said projection opening widths and a second of said step widths is substantially less in width than a second of said projection opening widths.

10. The hanger as defined in claim 1 wherein a first of said projections projects from the side walls of said tab.

11. The hanger as defined in claim 1 wherein a first of said projections projects from the base of said tab.

12. The hanger as defined in claim 1 further comprising a lock member on the base of said tab, said lock member projecting into the space between, and overlapping onto, the first receiver member and the second receiver member to prevent said receiver member from moving.

* * * * *